US007090316B2

(12) United States Patent
Model

(10) Patent No.: US 7,090,316 B2
(45) Date of Patent: Aug. 15, 2006

(54) TILTING ORGANIZER

(76) Inventor: Robert Model, 62 Lenhorne Dr., Cranford, NJ (US) 07016

( * ) Notice: Subject to any disclaimer, the term of this patent is extended or adjusted under 35 U.S.C. 154(b) by 148 days.

(21) Appl. No.: 10/724,243

(22) Filed: Nov. 28, 2003

(65) Prior Publication Data

US 2004/0130247 A1 Jul. 8, 2004

Related U.S. Application Data

(60) Provisional application No. 60/438,549, filed on Jan. 7, 2003.

(51) Int. Cl.
*A47B 88/00* (2006.01)

(52) U.S. Cl. ..... 312/323; 312/328; 312/348.1

(58) Field of Classification Search ..... 312/322, 312/323, 287, 332, 330.1, 334.7, 327, 328, 312/246; 248/291.1, 286.1, 284.1; 211/90.02, 211/126.15, 150; 411/349, 549, 553; 220/507, 220/23.86, 23.83, 23.87, 23.89
See application file for complete search history.

(56) References Cited

U.S. PATENT DOCUMENTS

| | | | | | |
|---|---|---|---|---|---|
| 222,816 | A | * | 12/1879 | Daniel | 312/327 |
| 1,108,281 | A | * | 8/1914 | Uffner | 312/323 |
| 2,199,731 | A | | 5/1940 | Pryne | |
| D139,753 | S | | 12/1944 | Adams | |
| 2,565,845 | A | * | 8/1951 | Frederick | 312/246 |
| 2,676,863 | A | * | 4/1954 | Cooper | 312/246 |
| 2,811,404 | A | * | 10/1957 | Brooks et al. | 312/122 |
| 3,897,855 | A | | 8/1975 | Paterson | |
| 3,975,071 | A | * | 8/1976 | Quinn | 312/323 |
| 4,066,306 | A | | 1/1978 | Klinder | |
| 4,368,866 | A | * | 1/1983 | Urban | 248/286.1 |
| 4,441,771 | A | * | 4/1984 | Roesler | 312/322 |
| 4,460,145 | A | * | 7/1984 | Ando | 248/447 |
| 4,602,855 | A | | 7/1986 | Frey | |
| 4,752,863 | A | | 6/1988 | Parrott | |
| 5,119,942 | A | | 6/1992 | McCullars | |
| 5,140,915 | A | | 8/1992 | Knape | |
| 5,213,401 | A | * | 5/1993 | Hatcher | 312/208.1 |
| 5,302,015 | A | * | 4/1994 | Du Vall | 312/282 |
| 5,306,077 | A | * | 4/1994 | Trevaskis | 312/122 |
| 5,524,980 | A | | 6/1996 | Carter et al. | |
| 5,890,605 | A | | 4/1999 | Percudani | |
| 5,954,413 | A | | 9/1999 | Brown | |
| 5,996,822 | A | | 12/1999 | Hopkins | |
| 6,039,422 | A | | 3/2000 | Butters et al. | |
| 6,126,257 | A | * | 10/2000 | Carpenter et al. | 312/9.44 |
| 6,382,746 | B1 | * | 5/2002 | Rosas | 312/227 |

* cited by examiner

*Primary Examiner*—Lanna Mai
(74) *Attorney, Agent, or Firm*—Ryder IP Law, P.C.; Douglas J. Ryder

(57) ABSTRACT

A tilting organizer including a base section and a supply section movably connected to the base section. The base section being a single unit having no movable parts and including at least one sidewall with a groove formed therein. The supply section being a single unit having no movable parts and including a plurality of compartments formed therein for storage and an arm formed in an exterior sidewall for movably engaging the groove. When the arm moves within the groove the supply section moves within the base section. The supply section can extend from the base section and tilt so as to provide a topical view and access to the compartments.

15 Claims, 20 Drawing Sheets

TILTING ORGANIZER

This application claims priority under 35 U.S.C. §119(e) of Provisional application No. 60/438,549, filed on Jan. 7, 2003 entitled "Tilting Medicine Cabinet Organizer". The aforementioned Provisional application is herein incorporation by reference, but is not admitted to be prior art.

BACKGROUND

When items are stored on shelves there is often wasted space as some items can not stand vertically and can not be stacked horizontally on top of one another. For example, in a medicine cabinet such items as toothbrushes, Q-tips, brushes, medication tubes, and make-up often can not be stored vertically on their own and can not be stacked horizontally upon one another. Storage units, such as cups and boxes, are often used to store these type of items vertically. When the items are stored vertically in the storage units it is often hard to see the actual contents of the storage unit or to get access to the contents of the storage units without removing the storage unit. Accordingly the storage units are often not secured so that they may be removed to get access to the contents stored therein. As the storage units are not secured they may tip over spilling the contents. Moreover, if multiple storage units are utilized to store multiple items, the various storage units may interfere with one another.

Accordingly there is a need for an organizer that provides a plurality of storage compartments that can be secured to a location and can provide visibility and access to the contents stored therein.

SUMMARY

A tilting organizer includes a base section and a supply section that is movably connected to the base section. The supply section includes a plurality of compartments to store and organize various items. The supply section can be extended out from the base section and then tilted so as to provide a clear view of and access to the contents contained therein. According to one embodiment, the base section and the supply section are connected together with no moving parts.

The base section includes at least a sidewall having a groove formed therein. The base section may optionally include a bottom, additional sidewalls, and a rear wall. The groove formed in the sidewall may extend through the entire sidewall or may be formed in an interior of the sidewall. The groove provides acts as a guide for the supply section to move within the base section.

According to one embodiment, the groove is formed in an upper surface of the sidewall and extends downward therefrom. At the end of the downward portion of the groove, the groove extends horizontally therefrom. At the end of the horizontal portion, the groove has a sloping portion. If the sloping portion is upward it will cause the supply section to tilt forward and provide a topical view and access to the contents of the compartments. According to one embodiment, a front portion of the sidewall will be lower than a rear portion of the sidewall.

The supply section includes a plurality of compartments formed therein. According to one embodiment the compartments are formed so that the opening of the compartments are on the top of the supply section. The supply section also includes an arm extending from an exterior surface of a sidewall. The arm is aligned with the groove. The arm and the groove movably engage one another and provide the movement of the supply section within the base section. According to one embodiment, the arm is rod shaped. The arm may have protrusions extending from an outer edge thereof. The protrusions being used to hold the arm within the groove. The supply section may also include dividers to divide the compartments into sub-compartments.

According to one embodiment, the base section and the supply section are single units and have no moving parts.

BRIEF DESCRIPTION OF THE DRAWINGS

The features and advantages of the various embodiments will become apparent from the following detailed description in which.

DETAILED DESCRIPTION

Figure 1A:
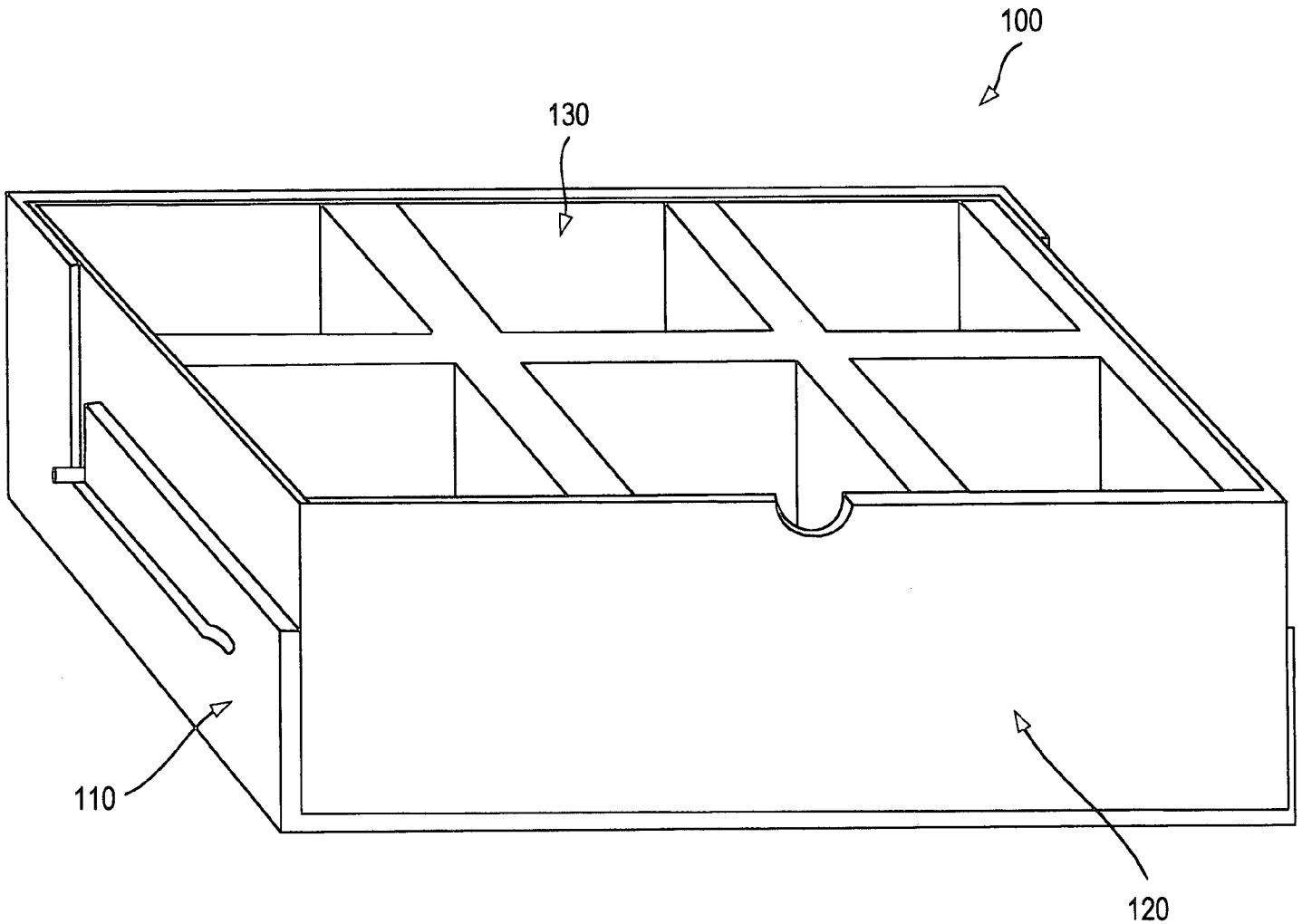
FIG. 1A illustrates an exemplary perspective view of a tilting organizer, according to one embodiment.

In describing various embodiments illustrated in the drawings, specific terminology will be used for the sake of clarity. However, the embodiments are not intended to be limited to the specific terms so selected, and it is to be understood that each specific term includes all technical equivalents which operate in a similar manner to accomplish a similar purpose.

With reference to the drawings, in general, and FIGS. 1 through 8C in particular, the various embodiments are disclosed.

Figure 1B:
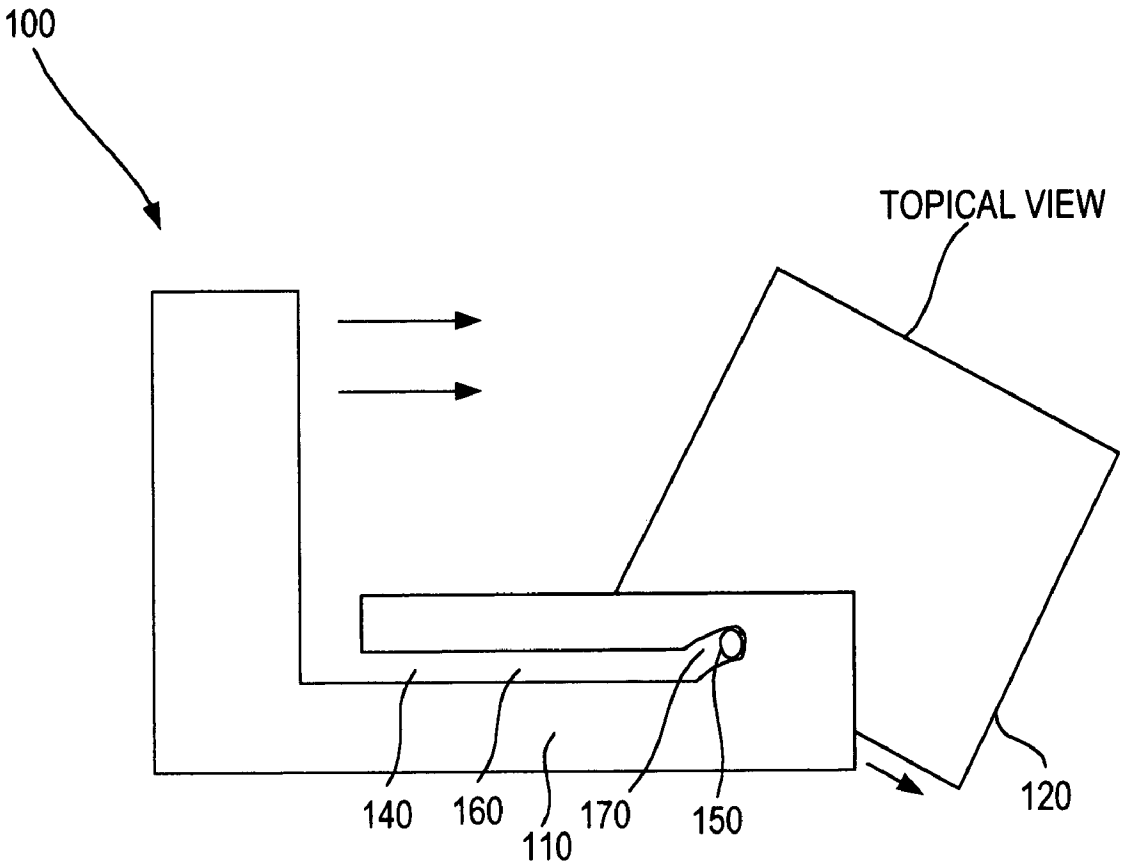
FIG. 1B illustrates an exemplary side view of a tilting organizer, according to one embodiment.

FIGS. 1A and 1B illustrate an exemplary tilting organizer 100. FIG. 1A illustrates an exemplary perspective view of the tilting organizer 100 in a stationary (storage) position. The tilting organizer 100 includes a base section 110 and a supply section 120 set inside the base section 110. The supply section 120 has a plurality of compartments 130 for storing items therein. The compartments 130 provide the ability to organize various items into different sections. The tilting organizer 100 can be used to store items that cannot stand vertically on their own. These items include, but are not limited to, tooth brushes, Q-tips, tweezers, screws, nails, pencils, and pens. Storing items in a vertical position may provide additional storage space as the items take up less horizontal space when stored vertically. If the items are stored horizontally the vertical space is wasted as the items likely cannot be stacked neatly upon one another.

FIG. 1B illustrates an exemplary side view of the tilting organizer 100 in a tilted (access) position. In the tilted position, the supply section 120 is slid forward and rotated (tilted) in a downward position to provide a topical view of the contents in the compartments 130 and access thereto. The base section 110 and the supply section 120 are engaged in a manner that allows the supply section 120 to be slid out of the base section 110 and tilted forward, while still providing support to the supply section 120. According to one embodiment, the base section 110 and the supply section are movably connected to one another with no moving parts (e.g., a passive connection).

As illustrated, the base section 110 has a groove 140 formed in its sidewalls and the supply section 120 has an arm (e.g., a rod) 150 extending from its sidewalls. The groove 140 includes a horizontal portion 160 and an upwardly angled portion 170. The arm 150 slides within the groove 140. When the arm 150 slides within the horizontal portion 160 the supply section 120 extends from the base section 110. When the arm 150 slides within the upwardly angled portion 170 the rear of the supply section 120 is lifted up causing the front of the supply section 120 to be lowered (tilting the supply section 120 forward).

Figure 2A:
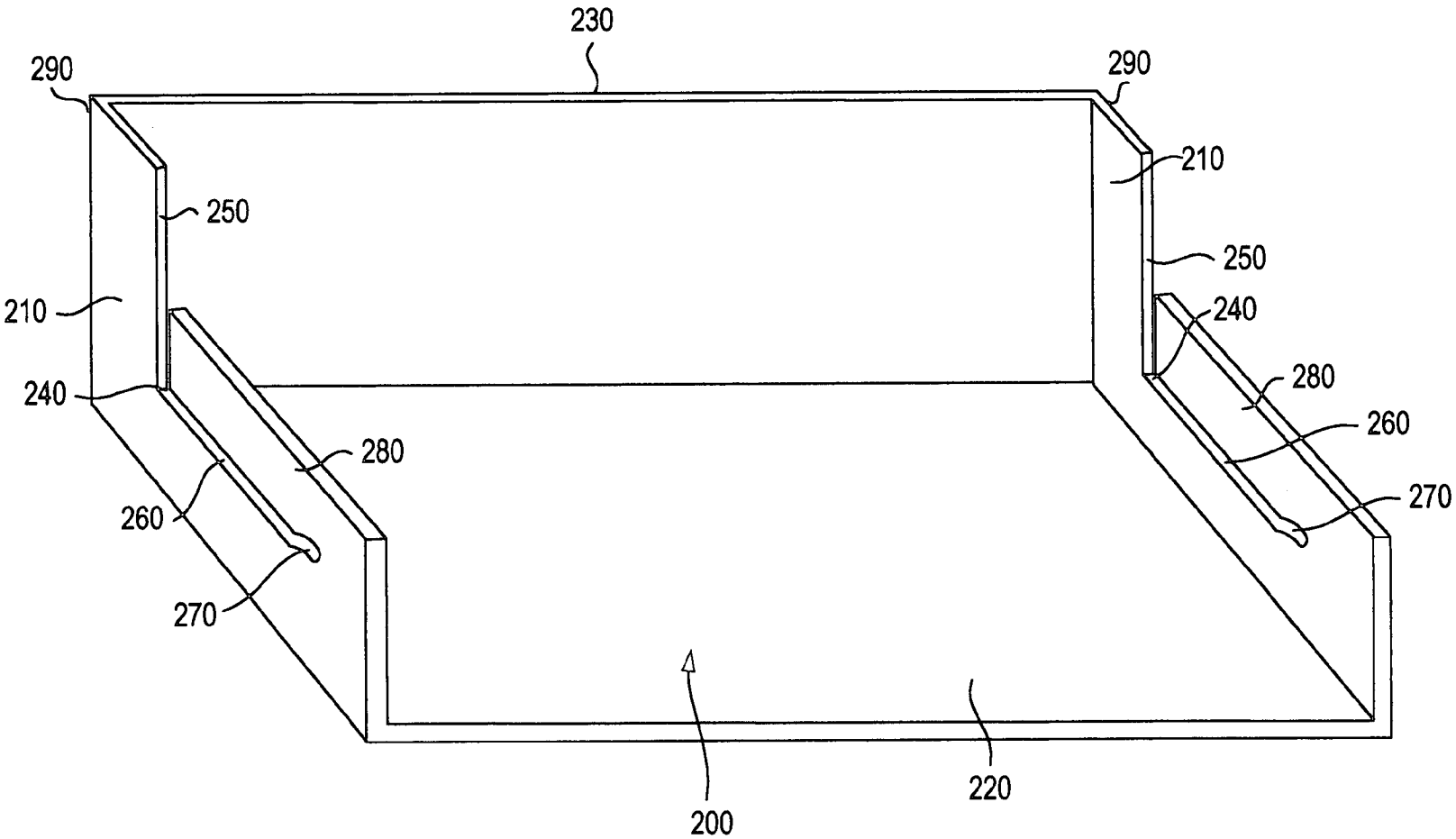
FIG. 2A illustrates an exemplary perspective view of a base section, according to one embodiment.

FIG. 2A illustrates an exemplary perspective view of a base section 200. The base section 200 provides a frame for which a supply section will be housed. The base section 200 includes sidewalls 210, a bottom 220, and a rear wall 230. The sidewalls 210 have a groove 240 formed therein. The groove 240 includes a vertical portion 250, a horizontal portion 260 and an angled portion 270. As discussed above, the groove 240 provides a route for the supply section to travel. The vertical portion 250 enables the supply section to enter the base section 200 from above. The horizontal portion 260 enables the base section to move horizontally within the base section. The angled portion 270 enables a rear section of the supply section to be raised up. According to one embodiment, the supply section will be extended past any support and will thus tilt forward at this point.

Figure 2B:
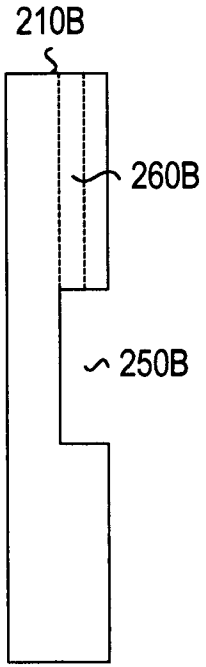
FIG. 2B illustrates exemplary perspective and top cross-sectional views of a sidewall, according to one embodiment.
Figure 2B:
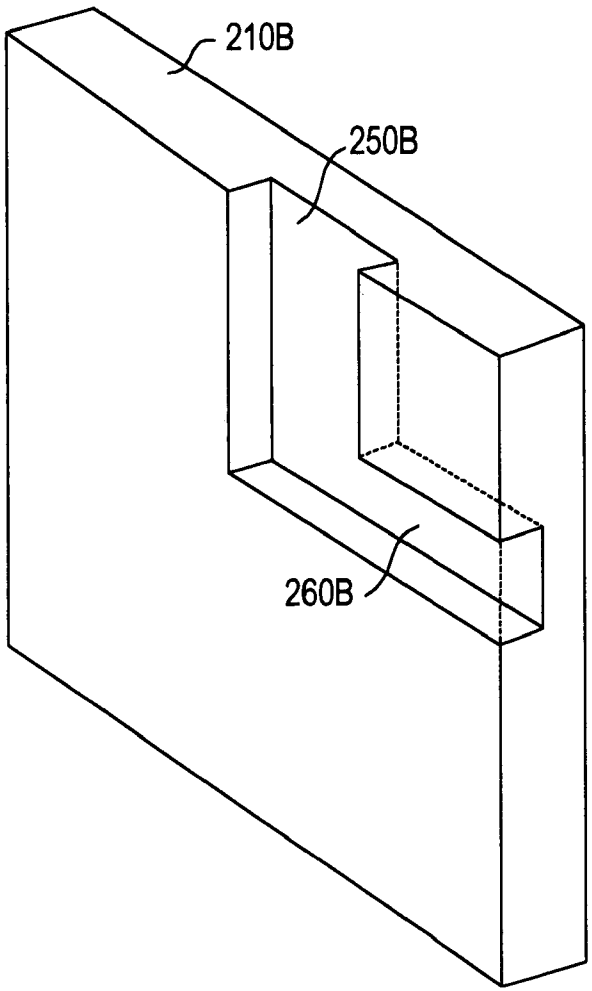

As illustrated in FIG. 2A, the groove 240 is cut completely through the sidewalls 210. However, the base section 200 is in no way limited thereto. For example, a groove may be formed only in an interior surface of the sidewalls 210. FIG. 2B illustrates an exemplary perspective view and top cross-sectional view of a sidewall 210B having a groove 240B formed in an interior surface thereof. The groove 240B having a vertical portion 250B, a horizontal portion 260B and an angled portion (not visible in FIG. 2B). If the groove is formed in an interior surface of a sidewall, the groove may be formed in a first direction and then extend perpendicularly therefrom after an initial depth. FIG. 2C illustrates an exemplary top cross-sectional view of a sidewall 210C having a vertical groove 250C extending laterally 252C into the surface and then extending perpendicularly therefrom 254C. As one skilled in the art would recognize, the perpendicular extensions 254C could extend in one direction (e.g., upwards), two directions (e.g., left and right) or circularly therearound.

Referring back to FIG. 2A, a front portion (in front of vertical portion 250) 280 of the sidewalls 210 is lower than a rear portion (behind vertical portion 250) 290. The lower front portion 280 allows the storage section to be inserted into the base section 200 at a lower height and thus requires less clearance. That is, an arm (e.g., a rod) in the supply section need only be lifted above the lower front portion 280 in order to enter the vertical portion 250 of the groove 240. However, utilizing a base section having sidewalls with a lower front portion is not the only manner to account for clearance issues, and the various embodiments are in no way limited thereto. For example, a groove may be formed in a front edge of the sidewall and the arm may enter at that point.

Figure 2D:
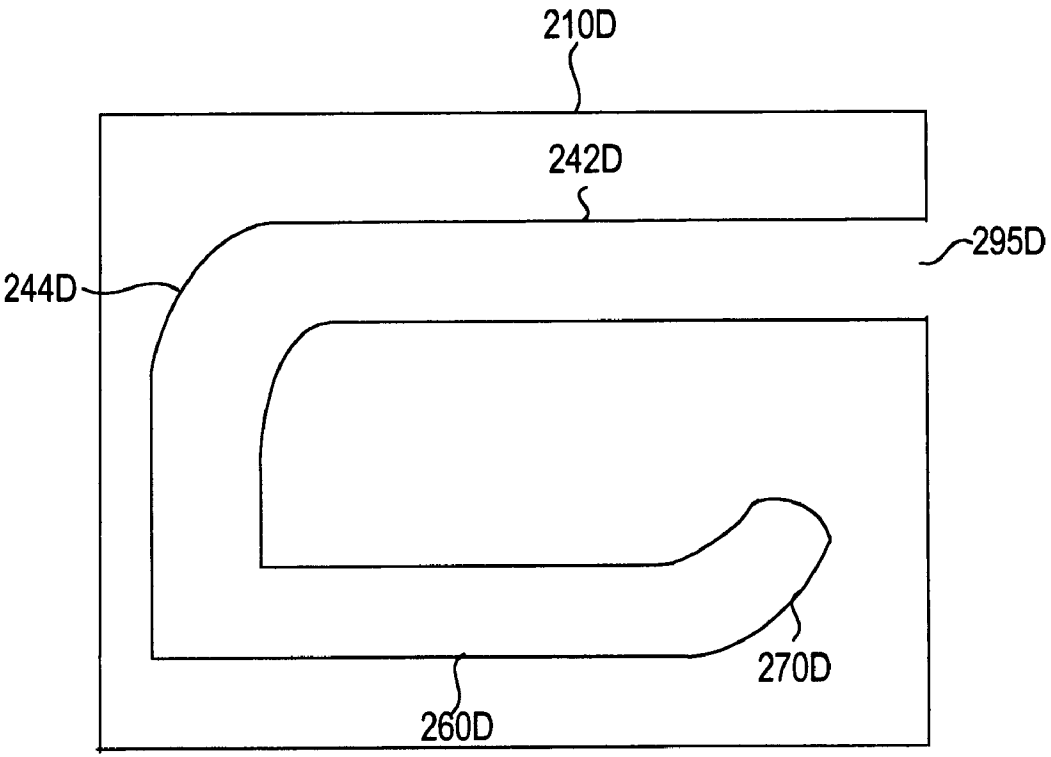
FIG. 2D illustrates an exemplary perspective view of a sidewall, according to one embodiment.
Figure 2C:
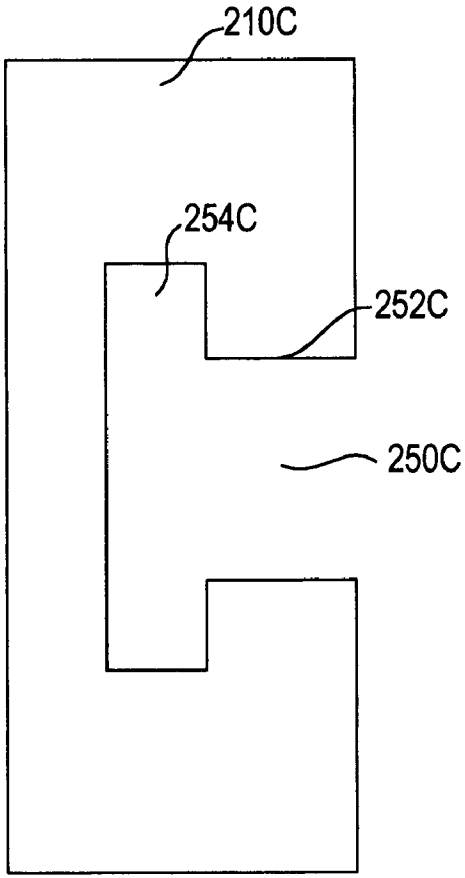
FIG. 2C illustrates an exemplary top cross-sectional view of a sidewall, according to one embodiment.

FIG. 2D illustrates an exemplary perspective view of a sidewall 210D with a groove 240D formed in an outer edge 295D that travels horizontally along the sidewall 242D, then turns and travels vertically 244D, then turns and travels horizontally back 260D toward the outer edge 295D, ending with a angled portion 270D. This embodiment, allows a supply section to be inserted in a base section 200D for areas that have limited clearance. The supply section is inserted in the groove 240D at the outer edge 295D and progresses backwards through the horizontal portion 242D until it reaches the vertical portion 244D at which point it is slid down into place in the base section 200D. When it is desired to extract the supply section from the base section 200D, the supply section slides along the horizontal portion 260D and then to the angled portion 270D at which point the supply section tilts downwards to provide a topical view and access (as previously described). It should be noted that the groove 240D could be competently through the sidewall 210D or could be in an interior surface of the sidewall 210D (with or without the perpendicular extensions discussed with respect to FIG. 2C). The sidewall 210D allows the supply section to be inserted at a lower height (e.g., height of groove 240D at the outer edge 295D) thus requiring less clearance.

Figure 2E:
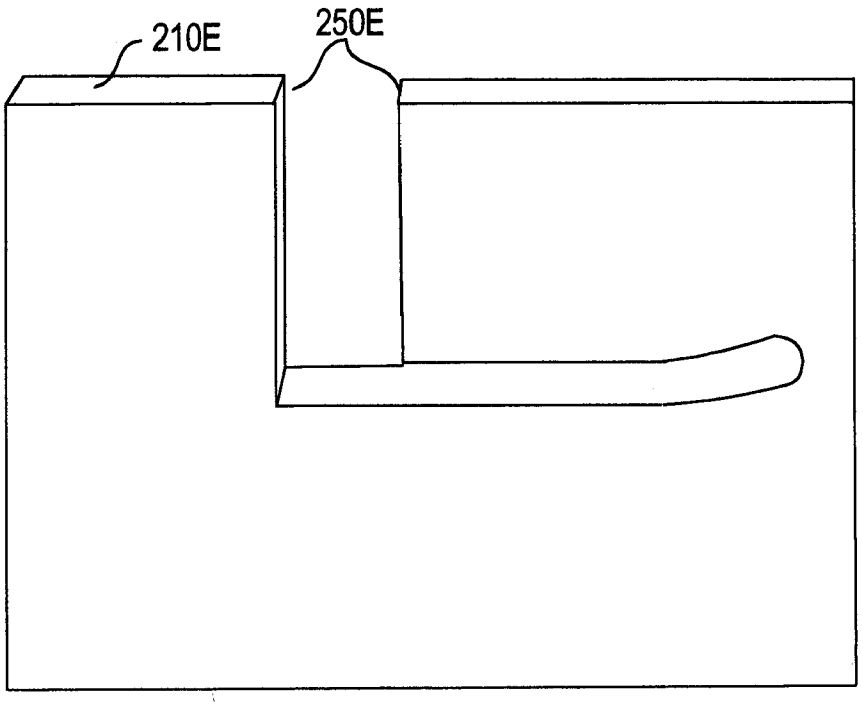
FIG. 2E illustrates an exemplary perspective view of a sidewall, according to one embodiment.

FIG. 2E illustrates an exemplary sidewall 210E having same height everywhere. A vertical portion 250E of a groove extends from an upper surface of the sidewall 210E. The sidewall 210E is used where clearance is not an issue, such a desk or workbench. That is, the supply section needs to enter the base section above the sidewall 210E.

According to one embodiment, the base section 200 is fabricated as a single unit. According to one embodiment, the base section 200 contains no moving parts. As one skilled in the art would recognize, the base section 200 could be modified in numerous ways without departing from the scope the various embodiments described above with respect to FIGS. 2A–E.

Figure 3A:
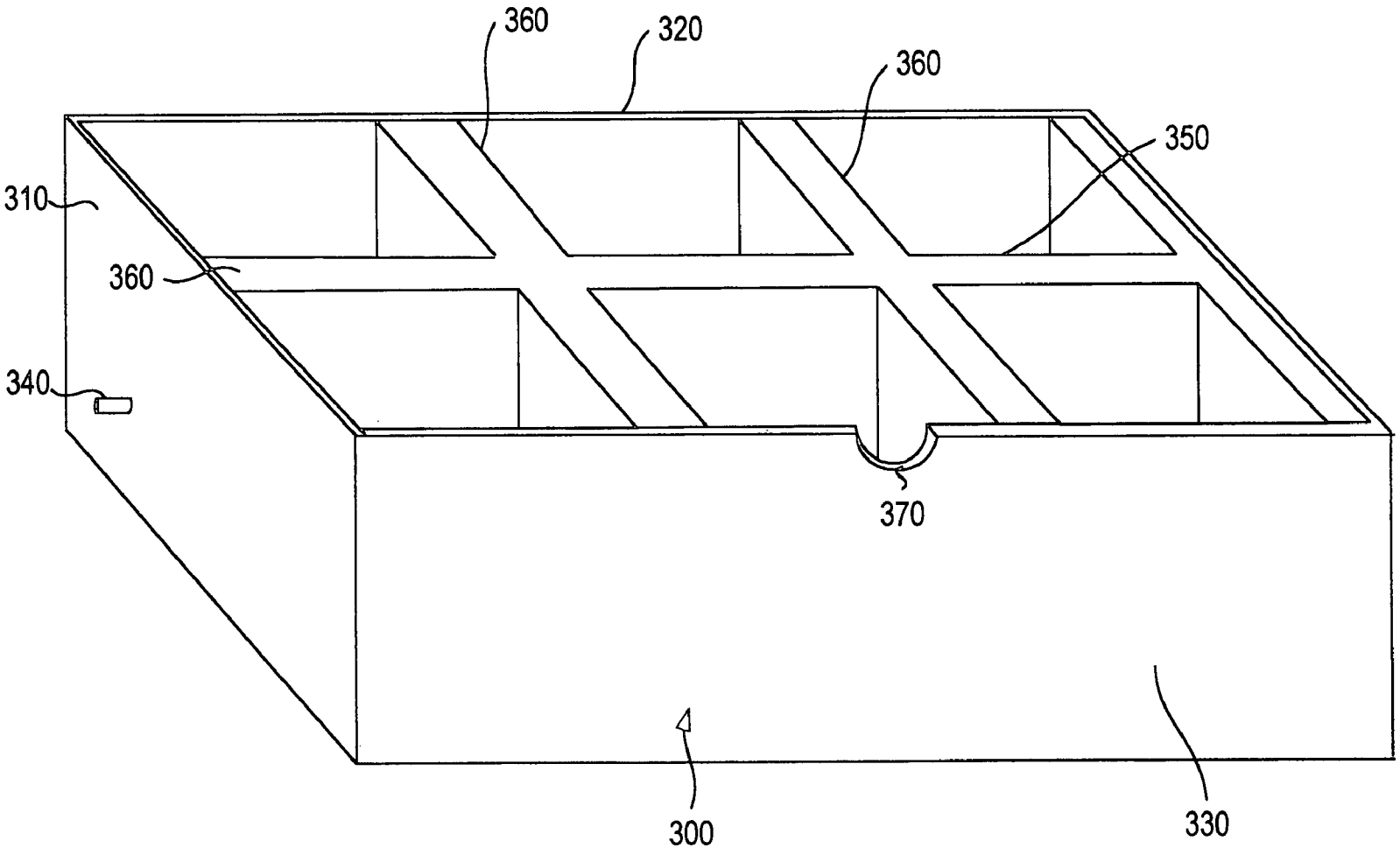
FIG. 3A illustrates an exemplary perspective view of a supply section, according to one embodiment.

FIG. 3A illustrates an exemplary perspective view of a supply section 300. The supply section 300 can store and organize various items and is capable of being moved in and out of a base section. When extended out of the base section it is also capable of being tilted forward to provide a topical view of the contents as well as easier access thereto. The supply section 300 includes sidewalls 310, a rear wall 320, a front wall 330, and a bottom (not visible in FIG. 3). The sidewalls 310 include an arm (e.g., a rod, a shaft) 340 extending therefrom. The arm 340 is used to movably connect the supply section 300 to the base section. The supply section 300 may be divided into smaller compartments 350 by interior walls 360. The compartments 350 enable the various items to be stored and organized. The front wall 330 may optionally have a thumb tab 370 formed in an upper edge thereof for ease of grasping the supply section 300.

As illustrated, the supply section 300 is divided into six smaller compartments 350 of equal size. However, the supply section 300 is in no way limited to any particular amount of compartments 350, and the compartments 350 are not limited to any particular shape and/or size. The interior walls 360 that form the compartments 350 may be permanent, removable, adjustable and/or some combination thereof.

Figure 3B:
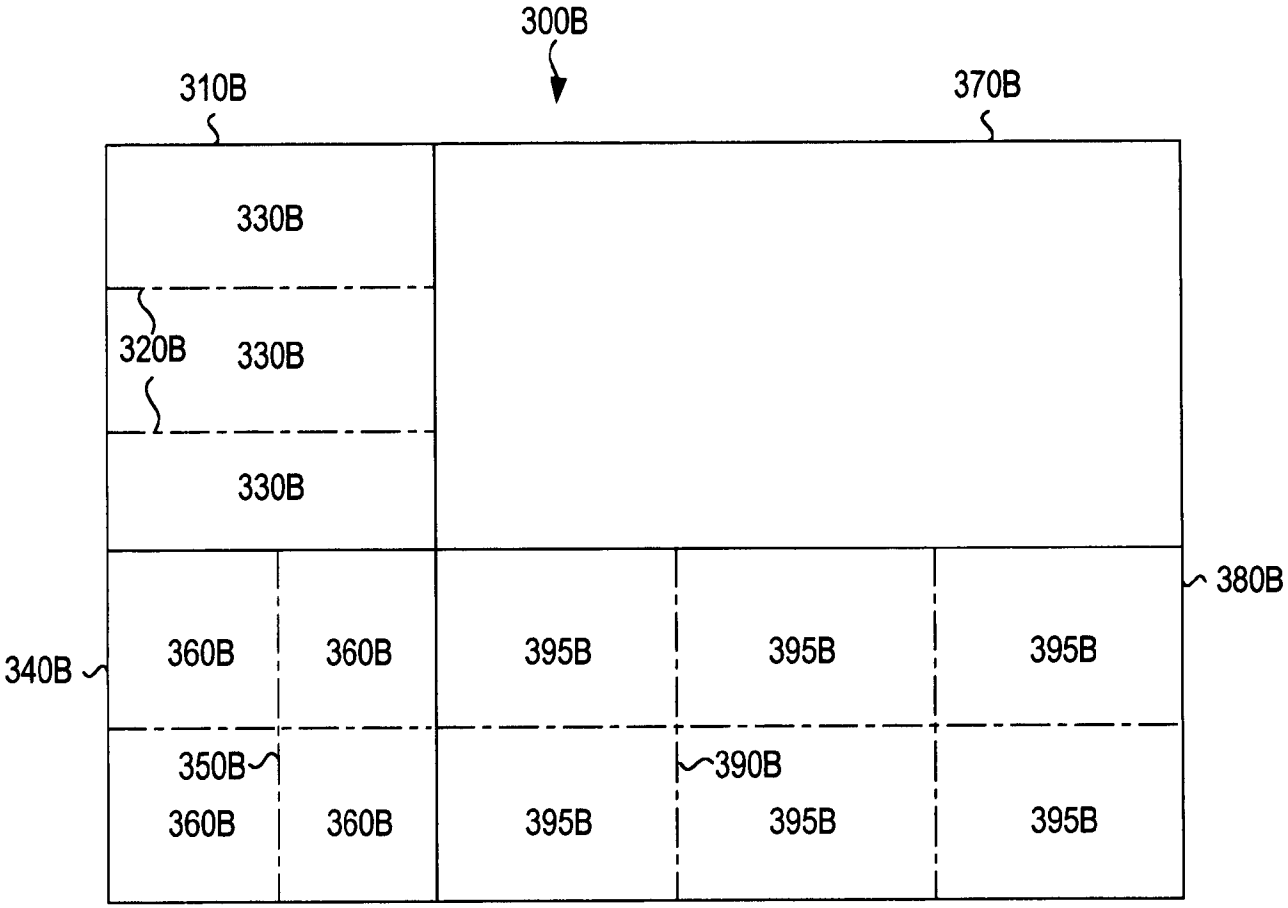
FIG. 3B illustrates an exemplary top view of a supply section, according to one embodiment.

Accordingly, the compartments 350 may be permanent, removable, adjustable or some combination thereof. According to one embodiment, dividers 370 may be used to further divide the compartments 350. The dividers 370 are preferably removable pieces that can divide the compartments 350 into sub-compartments. FIG. 3B illustrates an exemplary front view of a supply section 300B having 4 compartments. As illustrated, the compartments are not of equal size. The supply section 300B also includes dividers for segregating the compartments into sub-compartments. The dividers are preferably movable within the compartments so as to be able to customize the supply section 300B. For example, within a compartment you may want to segregate toothbrushes, makeup, screws, or pencils/pens. The dividers may be substantially the same size as the width and/or length of the compartments (or slightly smaller) so that they fit snug in the compartments. The dividers may include a lip on the top edge that rests on an upper edge of the walls of the compartments.

As illustrated, a first compartment 310B has two dividers 320B inserted horizontally therein to divide the compartment 310B into three sub-compartments 330B. A second compartment 340B has a divider 350B inserted therein to divide the compartment 340B into four sub-compartments 360B. The divider 350B may be a single fabricated piece or it may be multiple (e.g., two) pieces that are interconnected together. It should be noted that the divider 350B could also have been inserted so that the edges of the divider 350B are in the corner of the compartment 340B thus providing four diamond shape sub-compartments 360B. A third compartment 370B does not have any dividers. A fourth compartment 380B has a divider 390B that splits the compartment 380B into six sub-compartments 395B. The divider 390B could be a single fabricated piece or it could be two or more pieces that are interconnected together.

Referring back to FIG. 3A, the arm 340 is preferably formed as part of the base section 300. However, in alternative embodiments the arm 340 could be formed separately and then connected to the supply section 300 using glue, screws, or other connection mechanisms that would be known to those of ordinary skill in the art. As illustrated, the arm 340 is approximately in the middle of the sidewall 310. However, the arm 340 is in no way limited to being located approximately in the middle of the sidewall 310. Rather the arm 340 could be connected towards the top, bottom, front or rear of the sidewall 310. The placement of the arm 340 may be a design choice that takes into account considerations such as clearance, amount of tilt desired, and type of tilt desired.

As illustrated, the arm 340 is rod shaped (e.g., cylindrical) having a circular base and sidewalls extending therefrom. However, the arm 340 is not limited to being cylindrical, it could be numerous other shapes (e.g., elliptical) without departing from the scope of the current embodiment. The length that the rod 340 protrudes from the sidewall 310 is dependent on, among other things, how snug the supply section 300 and the base section fit together, whether the groove is through the entire sidewall of the base section, thickness of the base sidewall, and how far the arm 340 protrudes through the groove.

Figure 3D:
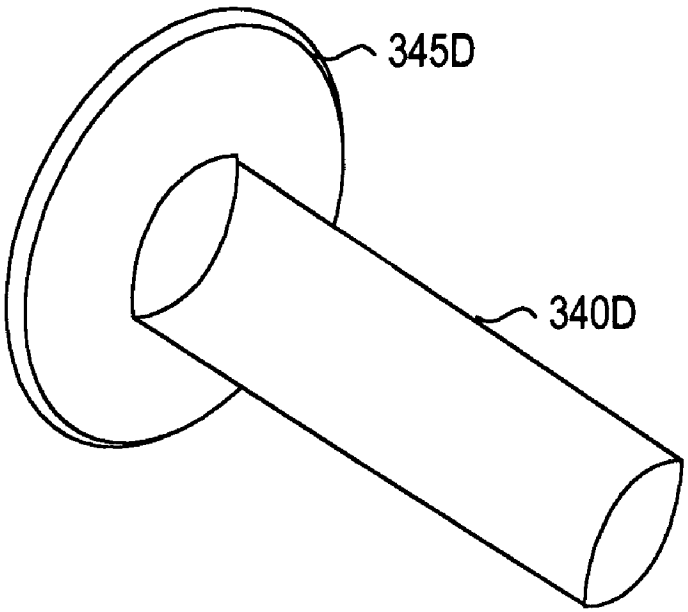
FIG. 3D illustrates an exemplary perspective view of an arm, according to one embodiment.
Figure 3C:
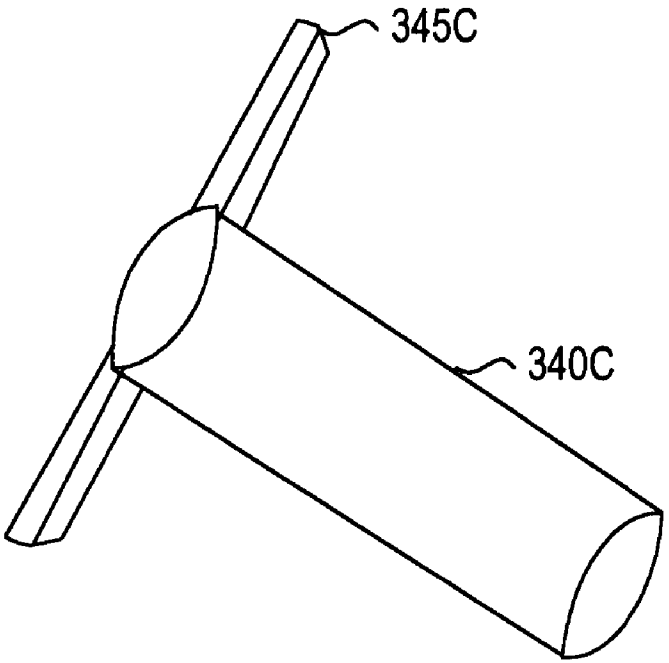
FIG. 3C illustrates an exemplary perspective view of an arm, according to one embodiment.

As illustrated, an outer edge of the arm (edge engaging the groove in the base sidewall) is the same as an inner edge (edge abutting the supply section supply wall). However, the arm 340 is in no way limited thereto. Rather the outer edge could have, for example, extensions (e.g., fingers) protruding therefrom. FIG. 3C illustrates an exemplary perspective view of an arm 340C having two fingers 345C extending from the outer edge. FIG. 3D illustrates an exemplary perspective view of an arm 340D having a circular surface 345D extending from the outer edge. The protrusions 345C, 345D from the outer edge are used to further secure the supply section into the base section.

According to one embodiment, the supply section 300 is fabricated as a single unit. According to one embodiment, the supply section 300 contains no moving parts. As one skilled in the art would recognize, the supply section 300 could be modified in numerous ways without departing from the scope the various embodiments described above with respect to FIGS. 3A–D.

Figure 4A:
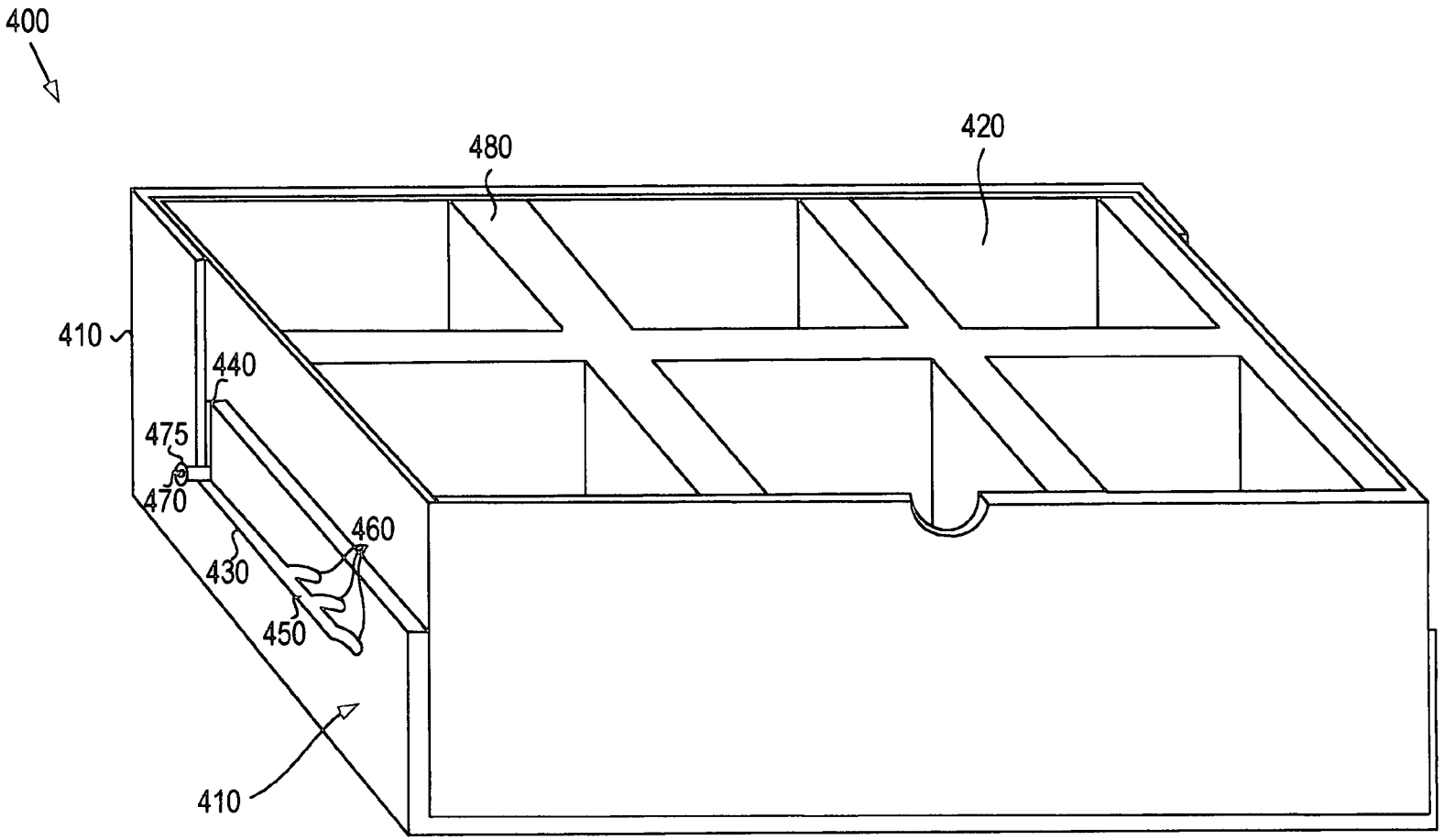
FIG. 4A illustrates an exemplary perspective view of a tilting organizer, according to one embodiment.
Figure 4B:
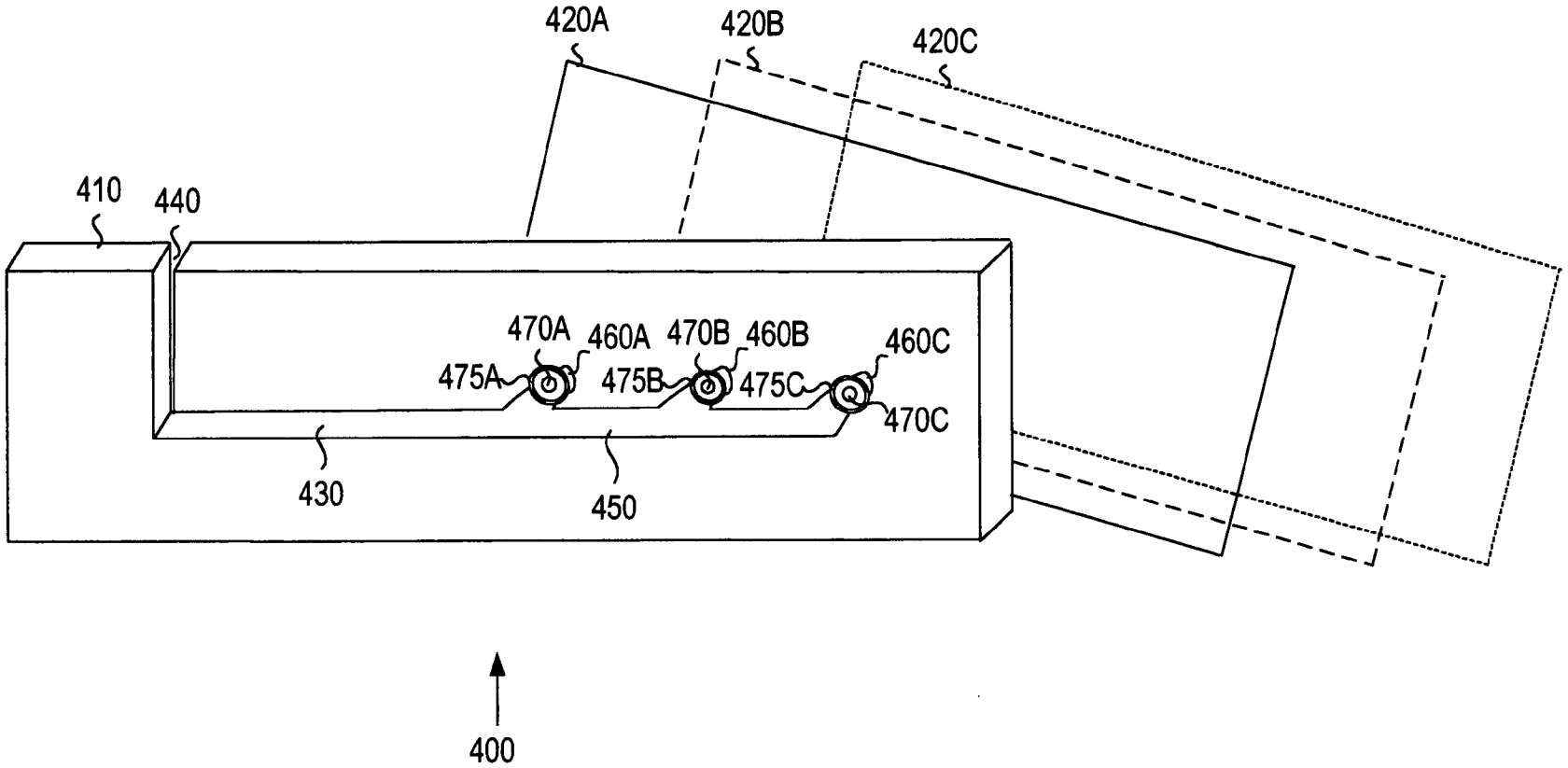
FIG. 4B illustrates an exemplary side view of a tilting organizer, according to one embodiment.

FIGS. 4A and 4B illustrate an exemplary tilting organizer 400. FIG. 4A illustrates an exemplary perspective view of the tilting organizer 400. The tilting organizer 400 includes a base section 410 and a supply section 420. The base section 410 includes a groove 430 in a sidewall (or each of two sidewalls). The groove 430 includes a vertical entrance 440, a horizontal track 450, and several upward sloping portions 460. The supply section 420 includes an arm 470 having a disk 475 extending from a far end. As previously discussed with respect to the previous embodiments, the arm 470 moves with the groove 430 to enable the supply section 420 to move within the base section 410. The disk 475 is used to assist in maintaining the arm 470 within the groove 430. The multiple sloping portions 460 enable the supply section 420 to be tilted forward at several locations. For example, if the tilting organizer 400 was fairly deep, and the supply section 420 had several compartments 480, one in front of one another, it may be beneficial to have the ability to tilt the supply section 420 at each compartment 480. In order to tilt the supply section 420 at the various compartments 480 (likely aligned in some fashion with the upward slopping portions 460), the arm 470 is pulled into the appropriate upward slopping portion 460.

FIG. 4B illustrates an exemplary side view of the tilting organizer 400 with the supply section 420 tilted at each of the various compartments 480 by having the arm 470 and disk 475 in the appropriate upward slopping portion 460. Each of the various possible tilting positions is indicated by a separate letter. For example, when the arm 470A is in sloping portion 460A the supply section 420A is tilted as illustrated. As one skilled in the art would recognize, the tilting organizer 400 could be modified in numerous ways without departing from the scope of this embodiment.

Figure 5A:
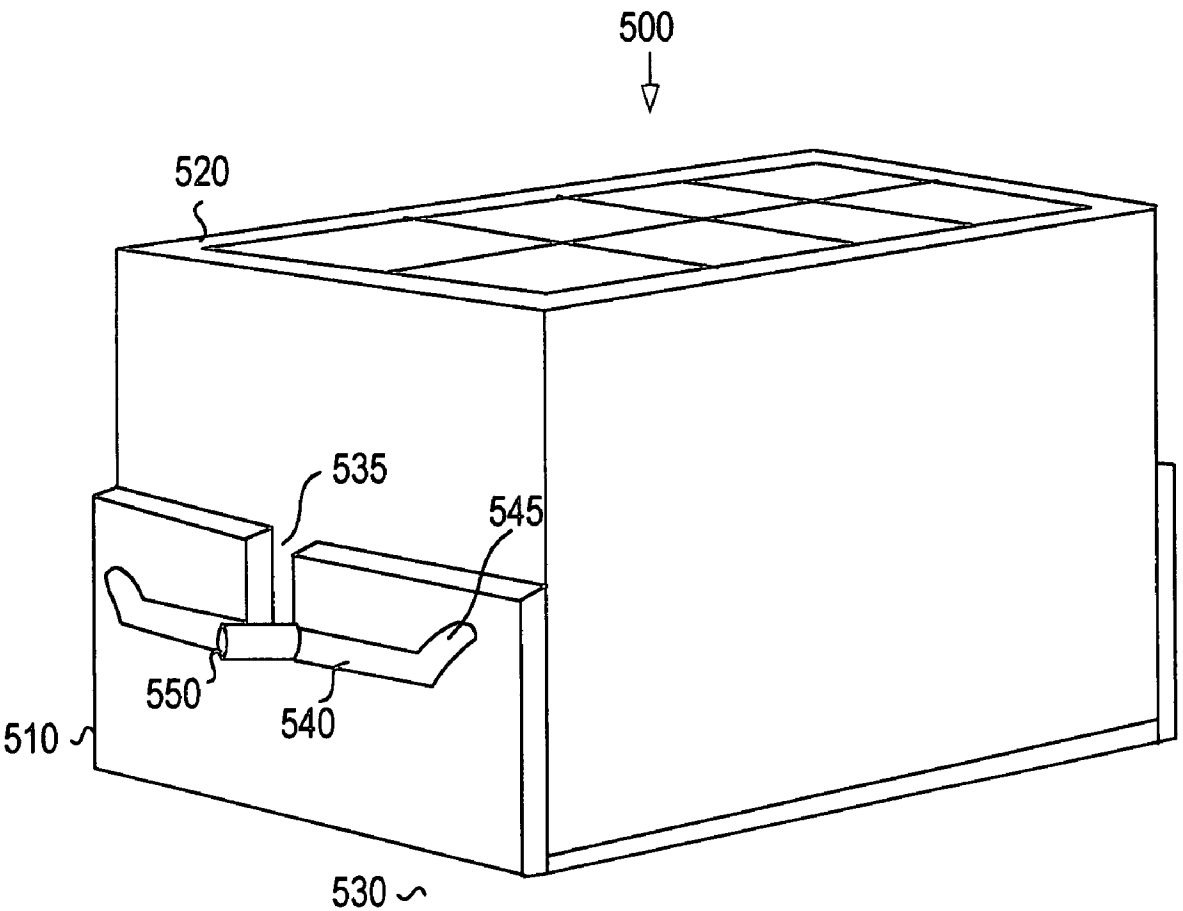
FIG. 5A illustrates an exemplary perspective view of a tilting organizer, according to one embodiment.
Figure 5B:
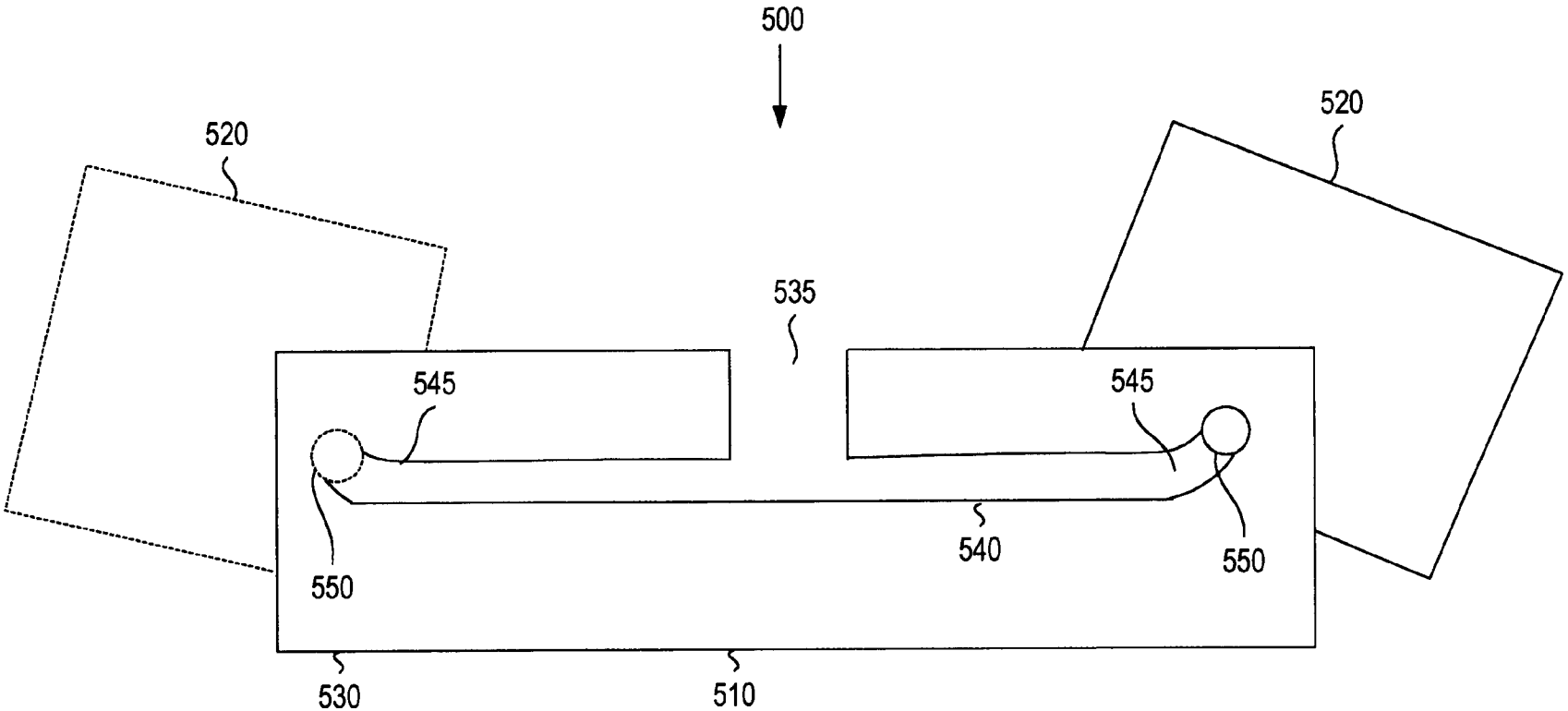
FIG. 5B illustrates an exemplary side view of a tilting organizer, according to one embodiment.

FIGS. 5A and 5B illustrate an exemplary tilting organizer 500. FIG. 5A illustrates an exemplary perspective view of the tilting organizer 500. The tilting organizer 500 includes a base section 510 and a supply section 520. The base section 510 includes sidewalls 530 and a bottom but does not include a front, back, or a top. The sidewalls 530 include an opening 535, a horizontal groove 540 extending in both directions from the opening 535, and an upward slopping region 545 at the end of the horizontal groove 540 in each direction. The supply section 520 includes an arm 550 protruding from a sidewall. As previously discussed with respect to the previous embodiments, the base section 510 and the supply section 520 are engaged when the arm 550 enters the opening 535. When the arm 550 moves within the groove 540, the supply section 520 moves within the base section 510. As the groove 540 proceeds from the opening 535 (in either direction) the supply section 520 can extend from either side of the base section 510. When the arm 550 enters the upward sloping regions 545, the portion of the supply section 520 within the base section 510 is lifted up and the portion of supply section 520 extending from the base section 510 is tilted forward.

FIG. 5B illustrates an exemplary side view of the tilting organizer 500. As illustrated, the supply section 520 can be extended from the right or the left side of the base section 510 and can tilt downward from the extended position. The supply section 520 is illustrated as a solid line as it extends to the right and a dotted line as it extends to the left to indicate that the supply section 520 is extended in one direction or another. According to one embodiment, the supply section 520 may actually be two separate supply sections, where one supply section extends to the right and one extends to the left.

The tilting organizer 500 can be used for areas where you may want to look at the contents within the supply section from either the front or the back. For example, the tilting organizer 500 may be used on free standing shelves (no back wall, access to shelves from both sides) or dividing walls between desks or workstations. In fact if bathrooms backed up to each other it is possible that a shared medicine cabinet could be installed between the two bathrooms and that the tilting organizer 500 could be used therein. As one skilled in the art would recognize, the tilting organizer 500 could be modified in numerous ways without departing from the scope of this embodiment.

Figure 6A:
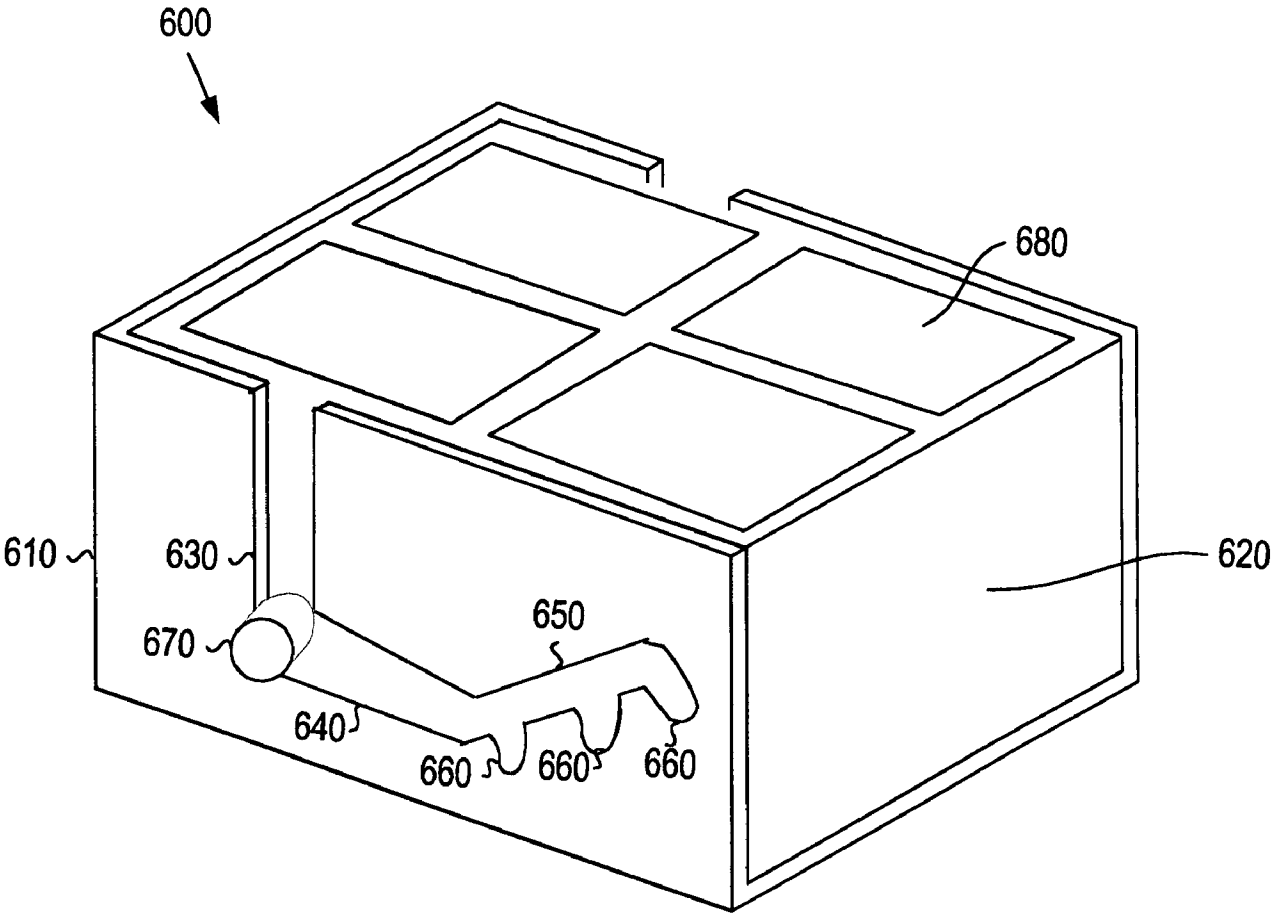
FIG. 6A illustrates an exemplary perspective view of a tilting organizer, according to one embodiment.
Figure 6B:
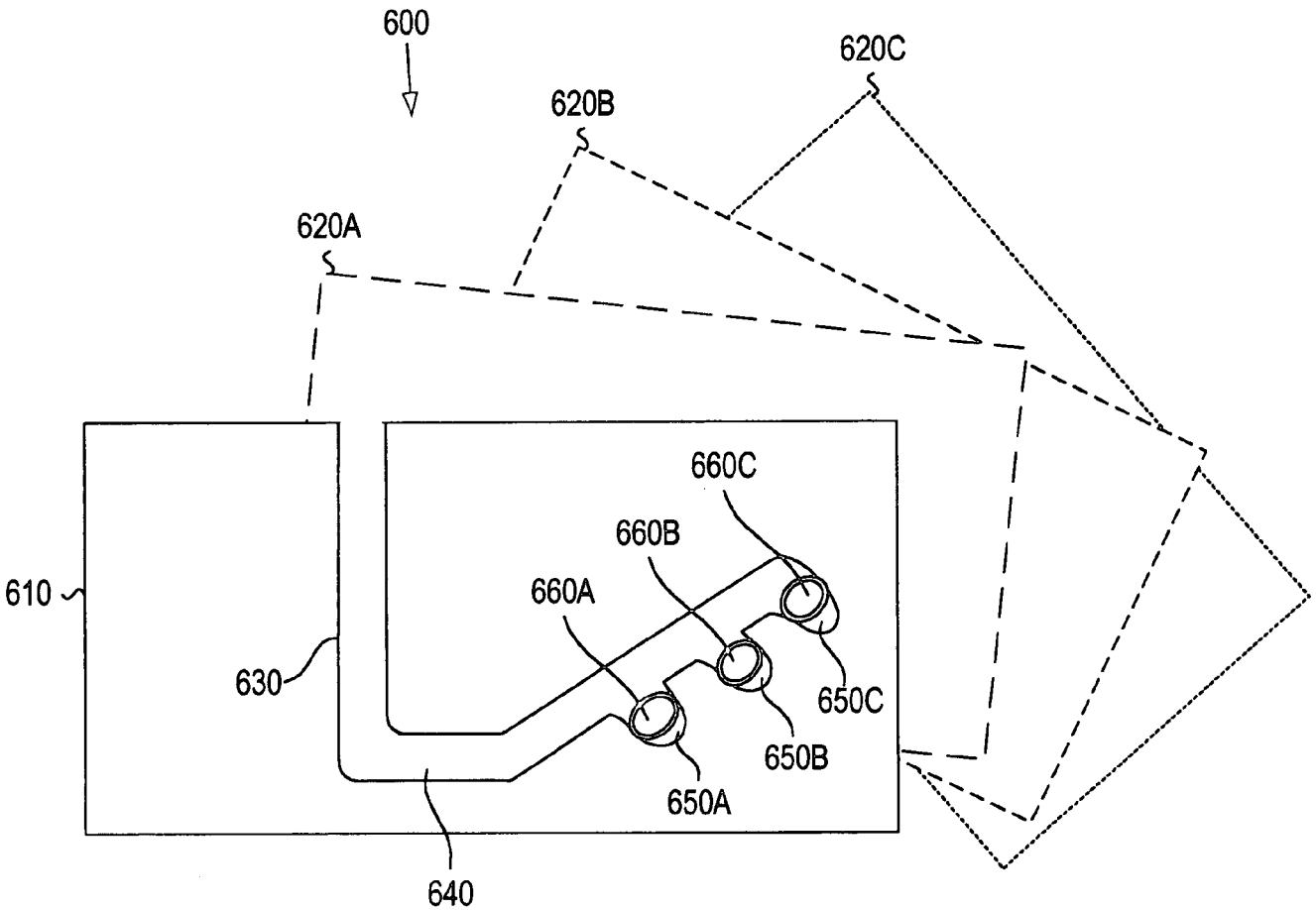
FIG. 6B illustrates an exemplary side view of a tilting organizer, according to one embodiment.

FIGS. 6A and 6B illustrate an exemplary tilting organizer 600. FIG. 6A illustrates an exemplary perspective view of the tilting organizer 600. The tilting organizer 600 includes a base section 610 and a supply section 620. The base section 610 includes a vertical channel 630 starting at a top edge of a sidewall and extending down the sidewall. The vertical channel 630 connects to a horizontal channel 640 that extends forward from the vertical channel 630. The horizontal channel 640 connects to an upward slopping portion 650. The upward sloping 650 portion has a plurality of fingers 660 extending downward therefrom. The supply section 620 includes compartments 680 and an arm (e.g., a rod) 670 formed in a sidewall thereof. The base section 610 and the supply section 620 become movably connected to one another by engaging the arm 670 and the groove (vertical channel 630, horizontal channel 640, upward sloping channel 650 and fingers 660). Engaging the arm 670 with the different fingers 660 causes the supply section to be tilted forward at different angels.

FIG. 6B illustrates an exemplary side view of the tilting organizer 600 with the supply section 620 tilted at various angels as the arm 670 is inserted in each of the different fingers 660. Each of the various possible tilting positions is indicated by a separate letter. For example, when the arm 670A is in the finger 660A the supply section 620A is tilted as illustrated. As one skilled in the art would recognize, the tilting organizer 600 could be modified in numerous ways without departing from the scope of this embodiment. For example, the upward sloping channel could be a vertically upward channel and the fingers could extend perpendicularly (horizontal) therefrom.

Figure 7A:
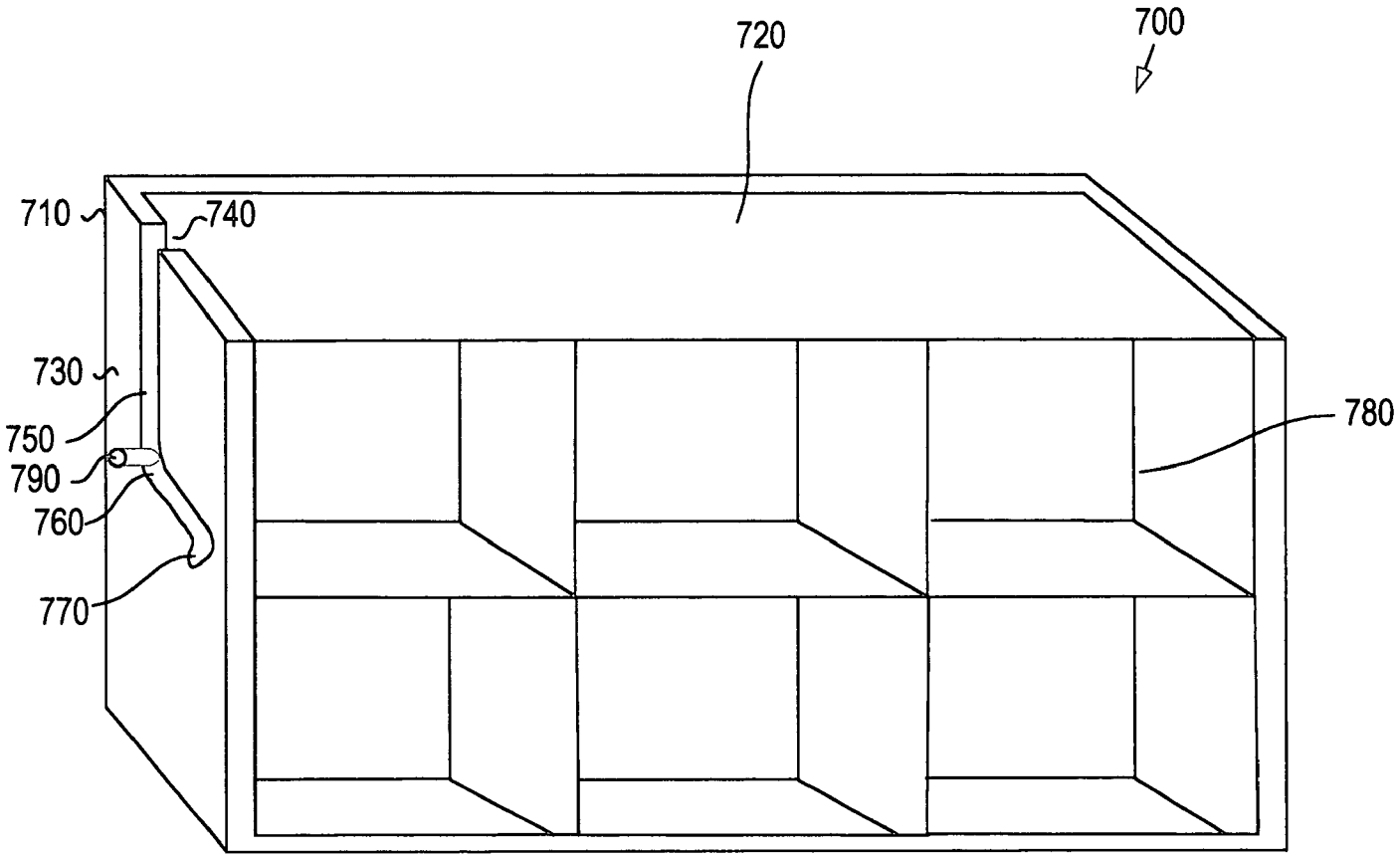
FIG. 7A illustrates an exemplary perspective view of a tilting organizer, according to one embodiment.
Figure 7B:
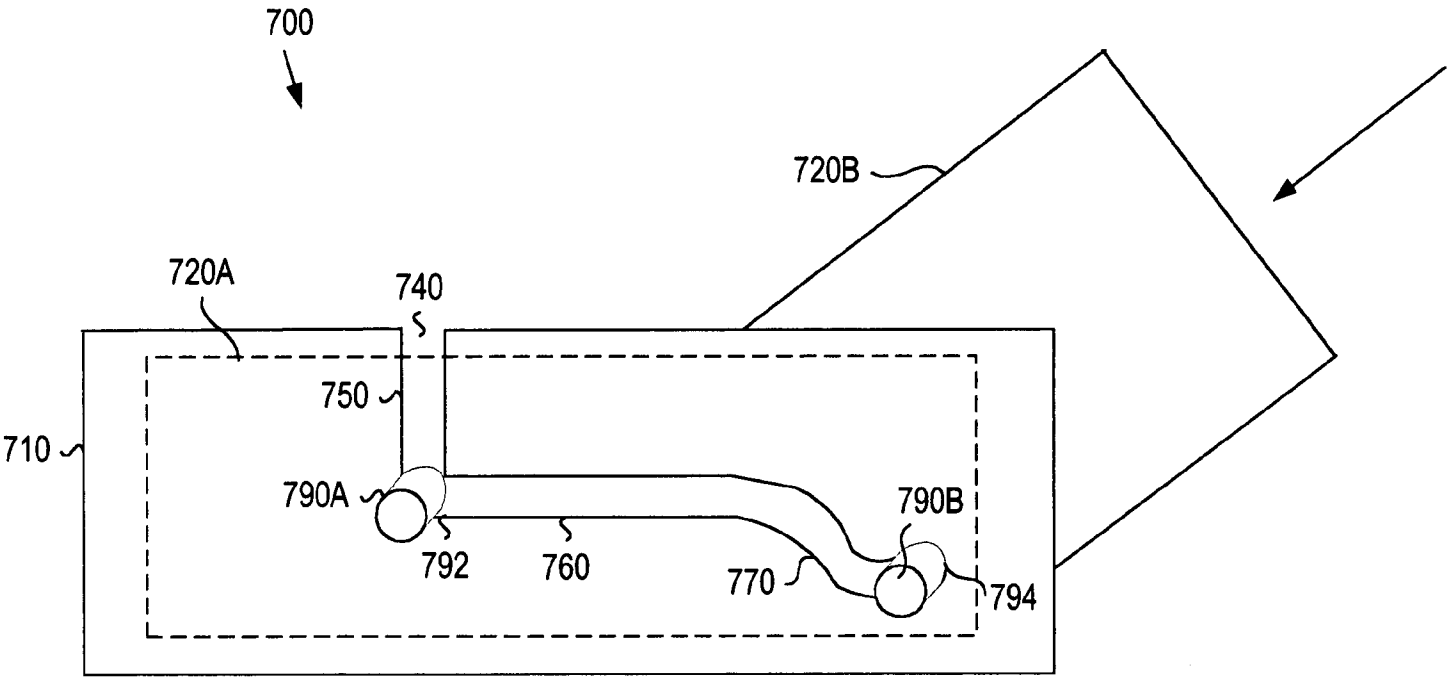
FIG. 7B illustrates an exemplary side view of a tilting organizer, according to one embodiment.

FIGS. 7A and 7B illustrate an exemplary tilting organizer 700. FIG. 7A illustrates an exemplary perspective view of the tilting organizer 700. The tilting organizer 700 includes a base section 710 and a supply section 720. The base section 710 includes sidewalls 730 having an opening 740 from in a top edge and a vertical channel 750 extending down the sidewall 730, until it meets a horizontal channel 760. The horizontal channel 760 ends with a downward slopping portion 770. The supply section 720 includes front facing compartments 780 and an arm (e.g., a rod) 790 formed in a sidewall thereof. The base section 710 and the supply section 720 become engaged when the arm 790 enters the opening 740 and proceeds down the vertical channel 750. When the arm 790 moves within the horizontal channel 760 the supply section 720 moves within the base section 710. When the arm 790 enters the downward sloping region 770, the back of the supply section 720 is lowered and the front of the supply section 720 is tilted backward. It should be noted that according to one embodiment, the supply section 720 would have to be raised up from the bottom of the base section 710 for the back of the supply section 720 to be lowered and cause the front of the supply section 720 to tilt back.

FIG. 7B illustrates an exemplary side view of the tilting organizer 700 in a stationary position 720A and a tilting position 720B. In the stationary position, the arm 790A is located at a stationary point 792 in the groove 760 and the bottom of the supply section 720A is sitting a distance above the bottom of the base section 700 (e.g., clearance between the bottom of the supply section 720A and the base section 710). The clearance permits the arm 790 to proceed down the downward sloping portion 770. In the titling position, the arm 790B is located in the downward slopping portion 770 (a tilting point 794) and the supply section 720B is titled backwards. In the tilting position, the front facing compartments 780 are now tilted back so that the contents do not fall out and so that the contents are visible and accessible from above. As one skilled in the art would recognize, the tilting organizer 700 could be modified in numerous ways without departing from the scope of this embodiment.

Figure 8A:
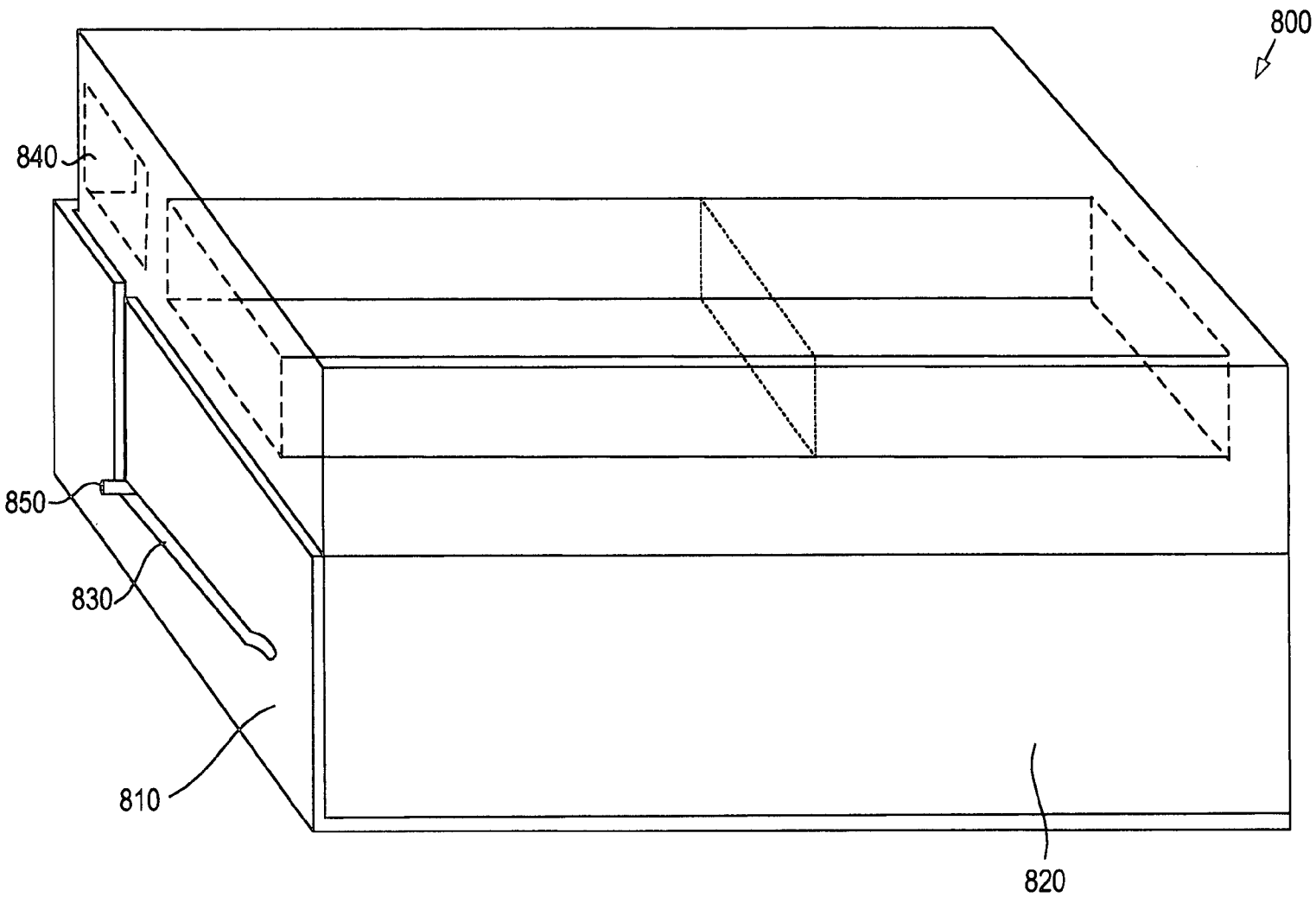
FIG. 8A illustrates an exemplary perspective view of a tilting organizer, according to one embodiment.
Figure 8B:
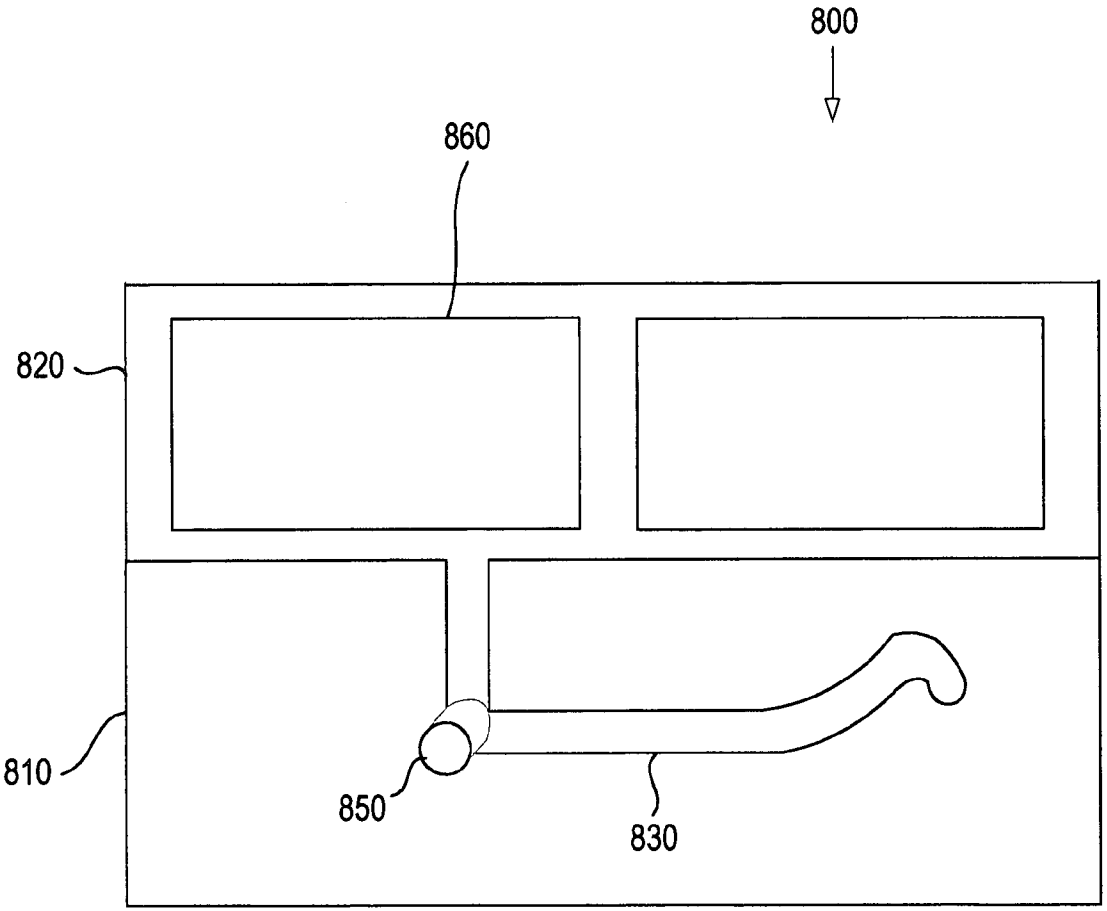
FIG. 8B illustrates an exemplary side view of a tilting organizer, according to one embodiment.
Figure 8C:
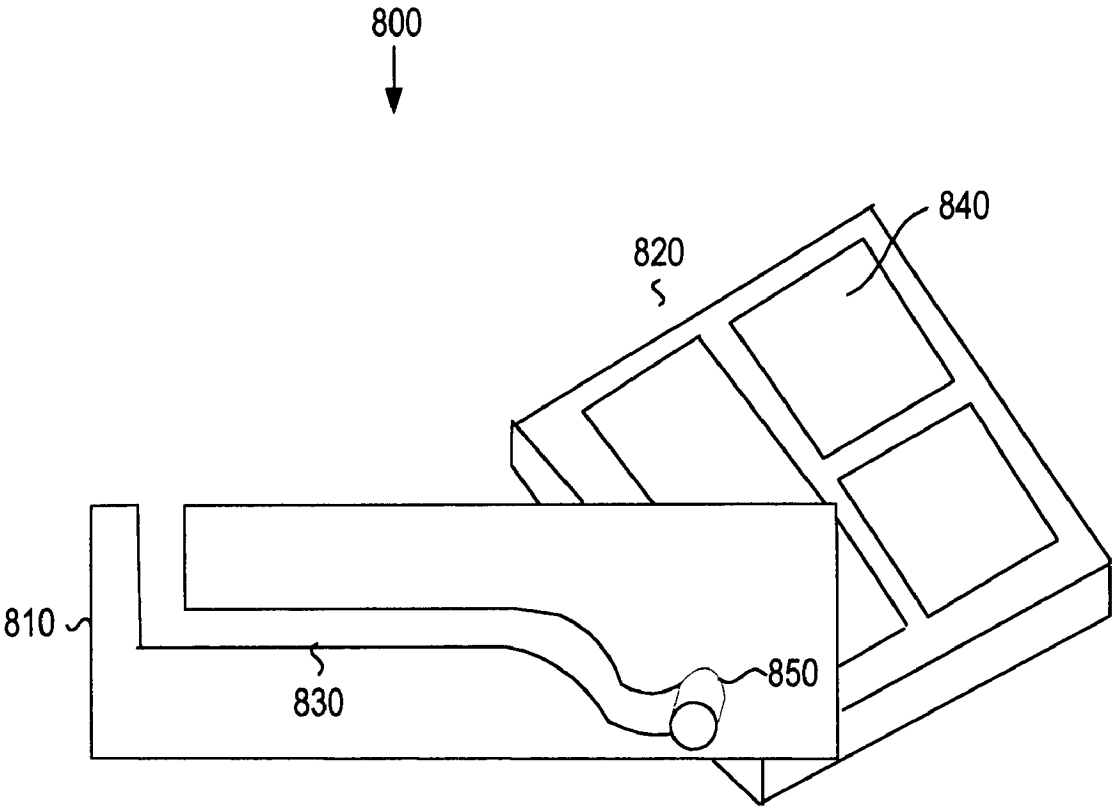
FIG. 8C illustrates an exemplary side view of a tilting organizer, according to one embodiment.

FIGS. 8A–C illustrate an exemplary tilting organizer 800. FIG. 8A illustrates an exemplary perspective view of the tilting organizer 800. The tilting organizer 800 includes a base section 810 and a supply section 820. The base section 810 includes a channel 830 formed in a sidewall. The channel 830 extends from an upper edge vertically downward, then horizontally forward, ending in an upward slanting portion. The supply section 820 includes side facing compartments 840 and an arm (e.g., a rod) 850 formed in a sidewall thereof. The base section 810 may only have a single sidewall with access to the side facing compartments being from the side with no sidewall. Alternatively, half sidewalls may be used so that upper side facing compartments are accessible at all times. As with the various other embodiments, when the arm 850 is slid horizontally within the channel 830 the supply section 820 extends from the base section 810 until the arm 850 enters the upward slanting portion at which point the back of the supply section 820 is raised and the front of the supply section 820 is tilted downward.

FIG. 8B illustrates an exemplary side view of the tilting organizer 800 in an inserted (closed) position. As illustrated, the base section 810 has a half sidewall so that there is access to the upper side facing compartments 840.

FIG. 8C illustrates an exemplary side view of the tilting organizer 800 in an extended position. In the extended position, the supply section is tilted forward providing access to the side facing compartments 840.

According to one embodiment, the supply section may include some combination of top compartments, side compartments, front compartments, and back compartments. The supply section will tilt in the appropriate direction based on the type of compartments contained therein so as to provide the best view and access to the contents within the compartments. Depending on where access to the compartments is going to be determines the type and quantity of sidewalls and rear walls. That is, if side access is needed the base section will either have half sidewalls, a single sidewall, no sidewalls, or some combination thereof. If rear access is required, the base section will have no backwall and the sidewalls will provide a groove (e.g., track) to enable the supply section to extend from the rear.

According to a preferred embodiment, the tilting organizer is made of a rigid plastic (e.g., acrylic). However, the tilting organizer may also be made of other plastics or other materials, such as wood or metal. The base section and the supply section are preferably made of the same materials but are not limited thereto. In a preferred embodiment the groove in the base section and the arm and inner walls that make up the compartments within the supply section are fabricated as part of the base and supply sections respectively. However, the groove made be formed in the base section after fabrication. Likewise the arm and/or inner walls may be formed separately and connected to the supply section after fabrication. If dividers are used it is preferable that they be made from the same material as the other components, though not limited thereto.

In order to provide an easy visual of the contents contained in the compartments, it is envisioned that the material that the tilting organizer is made of will be clear. However, it is in no way intended to be limited thereto. According to one embodiment, the tilting organizer may be made of colored see through material. All of the components could be the same color or the colors could be mixed and matched. According to one embodiment, the colors are coordinated to match the contents within the compartments (e.g., red represents medicines, green represents sharp objects such as scissors or tweezers, yellow represents soft items such as Q-tips, and blue represents make-up).

The tilting organizer may be connected to a surface by a temporary means, such as Velcro, magnets or straps. Alternatively, the tilting organizer may be connected via a permanent means, such as screws, nails and glue. If screws and/or nails are to be used to connect the base section to a surface, holes may be formed in the base section. The holes may be formed as part of the fabrication of the base section or may be formed (e.g., drilled) after fabrication of the base section. The tilting organizer may be connected to the surface by connecting the floor and/or the backwall of the base section to the surface and/or surfaces. According to one embodiment, the tilting organizer may not have a base section and the supply section may connect directly to the connecting surface(s).

As illustrated in the various embodiments, the tilting organizer is rectangular or square in shape. However, the shape and size of the tilting organizer are in no way limited thereby. Rather, as one of ordinary skill in the art would recognize the tilting organizer could be made any shape and any size to fit the specifications associated with where the tilting organizer is to be used. That is, the tilting organizer could be any size and any shape without departing from the scope of the various embodiments.

Although the detailed description has been illustrated by reference to specific embodiments, various changes and modifications may be made. Reference in the specification to "one embodiment" or "an embodiment" means that a particular feature, structure or characteristic described in connection with the embodiment is included in at least one embodiment. Thus, the appearances of the phrase "in one embodiment" appearing in various places throughout the specification are not necessarily all referring to the same embodiment.

The various embodiments are intended to be protected broadly within the spirit and scope of the appended claims.

What is claimed is:

1. A tilting organizer comprising a base section for mounting to a surface, wherein said base section includes a sidewall having a groove formed therein, the groove open at an upper edge and extending vertically downward;

a supply section having a plurality of compartments to store articles, wherein said supply section includes a plurality of walls forming the compartments and an arm protruding from an exterior wall aligned with the sidewall having the groove, wherein the arm and the groove engage to movably connect said base section and said supply section, wherein the arm has protrusions extending from an outer edge, and wherein said supply section can be extended out from said base section and then rotated to provide access to the plurality of compartments and wherein neither said base section nor said supply section has any moveable parts.

2. The tilting organizer of claim 1, wherein said base section and said supply section are each a single unit.

3. The tilting organizer of claim 1, wherein opening to the compartments is on top of said supply section, and said supply section rotates downward once extended out from the base section.

4. The tilting organizer of claim 1, wherein said supply section can extend out of base section forward and backward.

5. The tilting organizer of claim 1, wherein the compartments are formed in some combination of top, front and side of said supply section.

6. The tilting organizer of claim 1, wherein said supply section can rotate upward or downward.

7. The tilting organizer of claim 1, wherein said base section and said supply section are made of a rigid material.

8. The tilting organizer of claim 7, wherein the rigid material is a plastic.

9. The tilting organizer of claim 1, wherein said supply section can rotate at different angles.

10. The tilting organizer of claim 1, wherein the groove is formed through the sidewall.

11. The tilting organizer of claim 1, wherein the groove is formed in an inner surface of the sidewall.

12. The tilting organizer of claim 1, wherein the arm is a rod.

13. A tilting organizer comprising:

a base including at least a bottom and a side, wherein the side has a groove formed therein, the groove open at an upper edge and extending vertically downward to a stationary point, the groove extending horizontally forward from the stationary point and then extending diagonally up and forward, the groove ending at a tilting point at end of portion extending diagonally up and forward; and an organizer having a plurality of compartments formed therein, wherein the organizer has an arm formed in a side thereof, the arm engaging the groove and capable of moving within the groove in order movably engage said base and said organizer.

14. The tilting organizer of claim 13, wherein when the arm is located at the stationary point said organizer is within said base.

15. The tilting organizer of claim 13, wherein when the arm is located at the tilting point said organizer is extended out from said base and is tilted downward to provide access to the compartments.

* * * * *